US006612654B2

(12) United States Patent
Laws et al.

(10) Patent No.: US 6,612,654 B2
(45) Date of Patent: Sep. 2, 2003

(54) CHAIR WITH UPHOLSTERED INSERTS

(75) Inventors: David J. Laws, Provo, UT (US); Livingston E. Atkins, III, Orem, UT (US); Richard D. Smith, Springville, UT (US); Gregory W. Wilson, Sandy, UT (US)

(73) Assignee: Mity-Lite, Inc., Orem, UT (US)

( * ) Notice: Subject to any disclaimer, the term of this patent is extended or adjusted under 35 U.S.C. 154(b) by 0 days.

(21) Appl. No.: 10/039,206

(22) Filed: Jan. 4, 2002

(65) Prior Publication Data

US 2003/0127887 A1 Jul. 10, 2003

(51) Int. Cl.[7] ..... A47C 7/24

(52) U.S. Cl. ..... 297/440.11; 297/440.15; 297/440.22; 297/56; 297/218.1

(58) Field of Search ..... 297/440.1, 440.11, 297/440.2, 440.22, 419.1, 55, 56

(56) References Cited

U.S. PATENT DOCUMENTS

| | | | | | |
|---|---|---|---|---|---|
| 1,355,669 | A | | 10/1920 | Henry | |
| 2,186,301 | A | * | 1/1940 | La More | 297/440.21 |
| 3,291,529 | A | * | 12/1966 | Straits | 297/448.1 |
| 3,802,734 | A | | 4/1974 | Lindley | |
| 5,064,247 | A | * | 11/1991 | Clark et al. | 297/447.3 |
| 5,110,186 | A | * | 5/1992 | Clark et al. | 297/440.2 |
| 5,183,314 | A | * | 2/1993 | Lorbiecki | 297/440.22 |
| 5,297,851 | A | | 3/1994 | Van Hekken | |
| 5,513,899 | A | | 5/1996 | Michaels et al. | |
| 5,738,408 | A | * | 4/1998 | Wu | 297/239 |
| 5,779,317 | A | | 7/1998 | Neal | |
| 5,820,221 | A | | 10/1998 | Greaves et al. | |
| 5,947,562 | A | * | 9/1999 | Christofferson et al. | 297/440.22 |
| 5,954,391 | A | | 9/1999 | Gray | |
| 6,135,562 | A | | 10/2000 | Infanti | |
| 6,234,571 | B1 | | 5/2001 | Atkins et al. | |
| 6,279,991 | B1 | | 8/2001 | Atkins et al. | |
| 6,305,742 | B1 | | 10/2001 | Spendlove et al. | |
| 6,305,750 | B1 | | 10/2001 | Buono et al. | |
| 6,382,728 | B1 | * | 5/2002 | Buono | 297/440.2 |
| 6,386,627 | B1 | * | 5/2002 | Tsai | 297/16.1 |

* cited by examiner

*Primary Examiner*—Peter M. Cuomo
*Assistant Examiner*—Stephen D'Adamo
(74) *Attorney, Agent, or Firm*—Thorpe North & Western LLP

(57) ABSTRACT

An upholstered folding chair includes a chair frame, a base member permanently attached to the frame, and an upholstered insert configured to slide into and removably interlock with either the base member or the chair frame. The base member includes a retaining rim, which covers and protects at least some of the edges of the upholstered insert, and the base member and upholstered insert may have interlocking members which become hidden between the base and insert when the two are interlocked together. The base can be either a back base for receiving and supporting an upholstered chair back insert, or a seat base for receiving and supporting an upholstered chair seat insert.

18 Claims, 5 Drawing Sheets

CHAIR WITH UPHOLSTERED INSERTS

BACKGROUND OF THE INVENTION

1. Field of the Invention

The present invention relates generally to upholstered chairs. More particularly, the present invention relates to a chair having upholstered inserts which require very little labor to assemble.

2. Related Art

Folding chairs are often used in situations where it is desirable or necessary to provide varying numbers and/or varying layouts of chairs, such as during conventions, seminars, conferences, etc. In addition, folding chairs are often used in multipurpose areas, in which chairs are used for some functions, but must be cleared away and stored to provide a large open space for other functions.

Naturally, it is desirable that folding chairs be capable of being folded and stacked or aligned for storage in the smallest possible space. Accordingly, a variety of types and designs of folding chairs have been developed which can be unfolded and placed in a desired configuration for use, then folded and stacked for storage in a relatively small space. It also is desirable that folding chairs be comfortable. One disadvantage of many prior art folding chairs is that there tends to be a trade off between comfort and foldability: the chairs either fold well and are uncomfortable, or are comfortable without folding well. For example, typical prior art folding chairs have rigid metal seats and seat backs, which can be hard and uncomfortable. Fortunately, folding chairs with cushioned seats and cushioned seatbacks have also been developed. Unfortunately, these chairs still tend to utilize the rigid metal or wood seat bottoms and seatbacks, and the cushions tend to make the chairs quite bulky when folded. More recently, some cushioned folding chairs have been better designed with comfort and ergonomic considerations in mind-such as better lower back support, a more comfortable sitting recline angle, etc.-making them more tolerable for users.

Unfortunately, some prior art cushioned folding chairs still suffer from various drawbacks. For example, many designs require significant manual labor to apply the upholstery. Many upholstered folding chairs have the upholstery separately attached to a backing material, with the backing material then fixedly attached to the chair frame with fasteners such as screws, rivets, etc. Obviously, a large amount of labor is required to assemble these, including significant labor to apply the fasteners, and to hide unsightly edges of the upholstery fabric, etc. Additionally, the screws, rivets, etc., which secure the upholstery backing to the chair frame are generally exposed, and can be subject to tampering and vandalism. This tends to reduce the useful life of chairs, and presents unwanted costs and aggravation for the owner.

It also is desirable that folding chairs be durable and strong. It will be appreciated that a typical folding chair will be stored and used, folded and unfolded, innumerable times during its usefull life. Likewise, the chair must be able to support persons of various weights, and also withstand potentially abusive conditions. Unfortunately, when assembled, the upholstered portions of some folding chairs present many exposed upholstered edges, which are very prone to wear, particularly with frequent handling and use. For example, many folding chairs are stored merely by leaning one chair against a wall, and placing subsequent chairs in a series against the first chair. It will be appreciated that when handled in this way, the top and side upholstered edges of adjacent chairs will tend to rub against each other, in addition to contact with the persons doing the folding and stacking, all of which will tend to cause wear to the edges of the upholstery. Additionally, a plurality of folding chairs stacked against a wall can have a potential domino effect, causing additional damage to upholstered edges when they are knocked over. Finally, where the upholstery fabric is vinyl or other similar material, the upholstery edges are particularly prone to cracking, even as early as during construction of the chair. It will be apparent that there are many other ways in which the upholstered edges of these chairs may become damaged or worn.

SUMMARY OF THE INVENTION

It has been recognized that it would be advantageous to develop an upholstered chair wherein upholstery edges are hidden and protected.

It has also been recognized that it would be advantageous to develop a tamper-proof removable cushion for a folding chair, which has hidden connectors and a hidden interlocking mechanism.

It has also been recognized that it would be advantageous to develop an upholstered chair with upholstered inserts that are removable from the frame of the chair by one with proper tools and knowledge.

It has also been recognized that it would be advantageous to develop an upholstered cushion which easily slides into a frame of a folding chair, for efficient assembly.

In accordance with one aspect thereof, the invention advantageously provides an upholstered folding chair, comprising a base, permanently attached or secured to the chair frame, which can removably slidably receive an upholstered insert. In one embodiment, the base comprises a back base for receiving and supporting an upholstered chair back insert, and in another embodiment the base is a seat base for receiving and supporting an upholstered chair seat insert.

In accordance with another more detailed aspect thereof, the invention provides an upholstered chair, comprising a frame, a base member permanently attached to the frame, and an upholstered insert configured to slide into and removably interlock with either the base member or the chair frame.

In accordance with another more detailed aspect of the invention, the base member includes a retaining rim, which covers and protects at least some of the upholstered edges of the insert.

In accordance with still another more detailed aspect of the invention, the base member and upholstered insert include interlocking members which become hidden between the base and insert when the two are interlocked together.

Additional features and advantages of the invention will be apparent from the detailed description which follows, taken in conjunction with the accompanying drawings, which together illustrate, by way of example, features of the invention.

DETAILED DESCRIPTION

Figure 1:
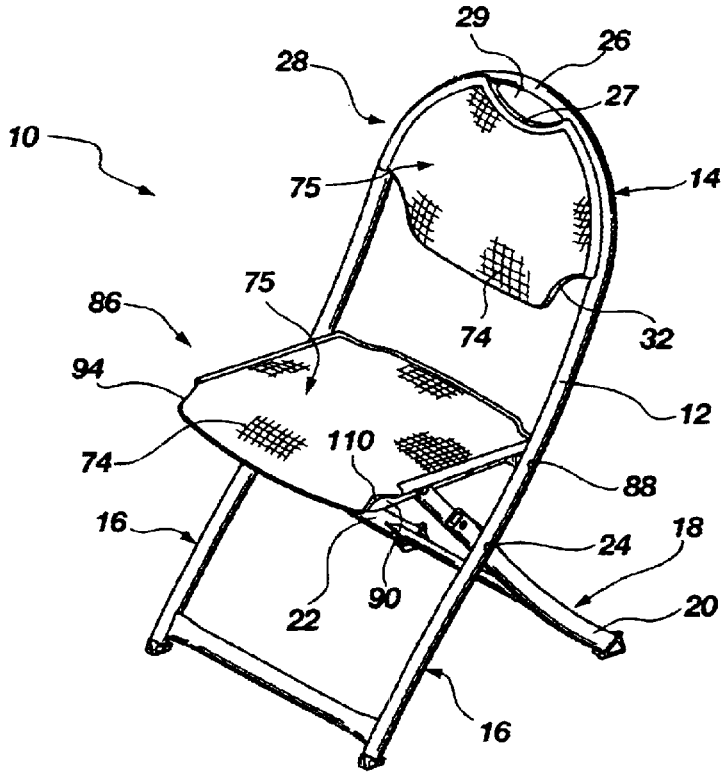
FIG. 1 is a front perspective view of one embodiment of a folding chair with removable upholstered inserts in accordance with the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the invention as illustrated herein, which would occur to one skilled in the relevant art and having possession of this disclosure, are to be considered within the scope of the invention.

As illustrated in FIG. 1, an upholstered folding chair 10 in accordance with the present invention is shown in a first, open, unfolded position. The folding chair of the present invention is designed to fold or collapse into a minimum thickness, such that the chairs have a very high storage density, particularly in comparison to many other upholstered folding chairs, while still providing strength, comfort, and durability. When folded, the chair is thin and presents a minimal profile. The thin profile of the chair may also be shaped or configured to facilitate nesting or indexing with adjacent chairs. It will be appreciated, however, that while the present invention is shown with respect to folding chairs, the present invention is not limited to folding chairs, and other types of chairs may be provided with upholstered inserts as disclosed herein.

Figure 8:
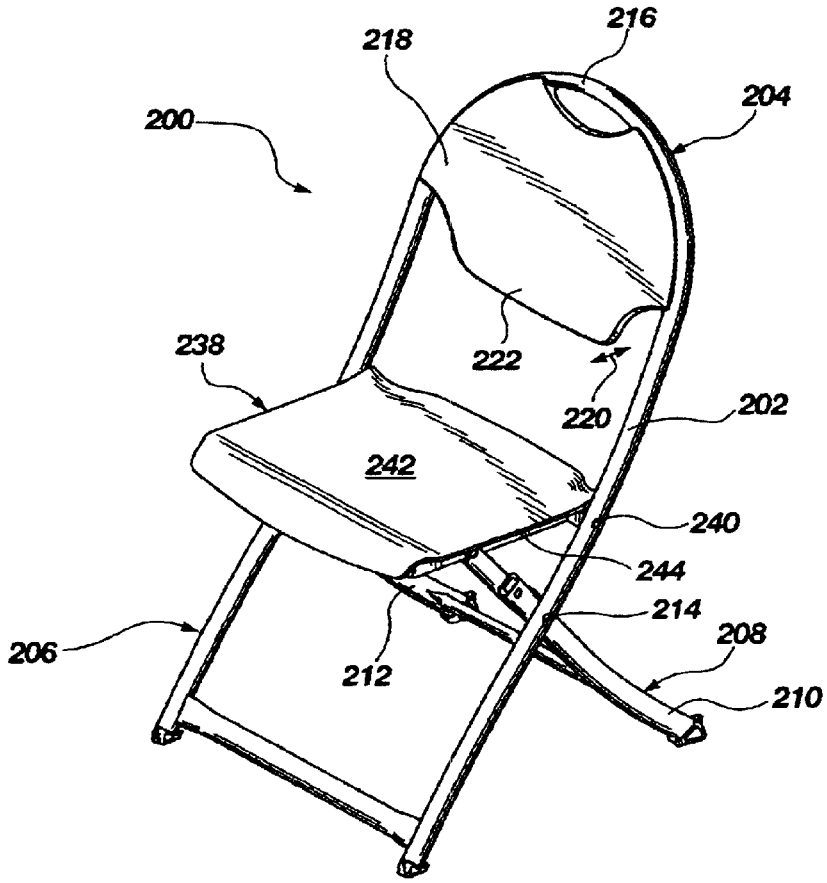
FIG. 8 (PRIOR ART)
FIG. 8 is a front perspective view of a prior art non-upholstered folding chair.
Figure 9:
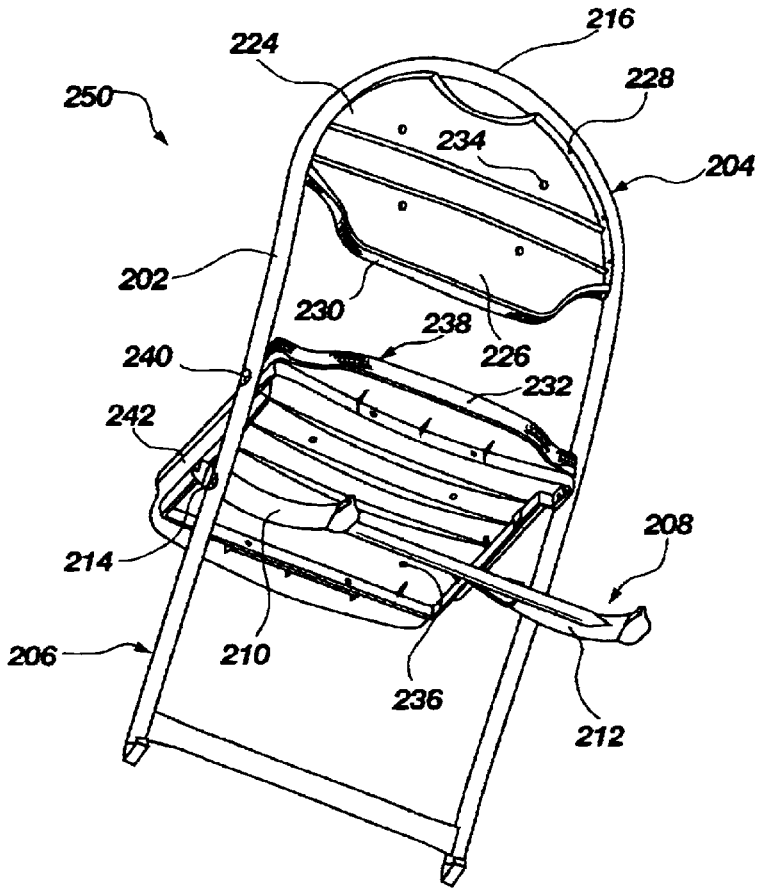
FIG. 9 (PRIOR ART)
FIG. 9 is a rear perspective view of a prior art chair similar to that of FIG. 8, having upholstery attached to the chair back and seat.

The chair 10 of FIG. 1 is similar in many respects to a prior art folding chair 200 shown in FIG. 8. A similar chair is also disclosed in U.S. Pat. Nos. 6,234,571, 6,279,991, and 6,305,742, the disclosures of which are incorporated herein by reference in their entireties. The folding chairs 200 of FIG. 8 and 250 of FIG. 9 are largely similar to each other, the primary difference being that the chair of FIG. 8 is non-upholstered, while the chair of FIG. 9 is upholstered. The overall construction and configuration of these two chairs are otherwise the same.

Both chairs have a rigid tubular support frame 202 having an upper back support portion 204 forming the back of the chair, and a lower front leg portion 206 formed integrally and continuously with the upper back support portion. The chairs also include a rear leg portion 208, which includes left and right rear legs 210, 212, which are pivotally coupled to the support frame 202 at leg pivot points 214. The support frame 202 may be a single integral member with a broad curved back member 216 formed at its top, as shown. As depicted, the support frame may be shaped to form a curved spline profile for easy stacking of folded chairs. Other shapes and designs are also possible Referring still to FIGS. 8 and 9, the prior non-upholstered chair 200 has a back support 218 coupled to the upper back support portion 204. The back support 218 has a generally concave curved surface to conform to a user's back, and is flexible and bends or flexes inwardly or rearwardly as force is applied, as indicated by arrow 220, such as when a person leans back against the back support. It includes a lower lumbar support region 222 which extends downwardly from the back support 218 to a lumbar region of a user's back. This provides additional cushioning for a user because in addition to the flexibility of the back support 218, the lumbar support member 222 also displaces rearwardly with respect to the back support. The lumbar support member may also have a reduced cross sectional area for providing greater flexibility.

The upholstered chair 250 is structurally similar to the non-upholstered chair 200, and includes a flexible back support 224 with a lower lumbar support region 226. However, the upholstered chair 250 includes an upholstered back cushion 230. For both chairs, the back supports 218, 224 are attached to the support frame by fasteners 228, such as rivets, as shown in FIG. 9.

The prior non-upholstered chair 200 also includes a seat portion 238 pivotally coupled to the support frame 202 at seat pivot points 240. The seat portion 238 includes a seating surface 242 secured to a seat frame 244. The seat frame is of the same material as the support frame 202, typically metal, and extends generally around the perimeter of the seat, or along the sides, front and back of the seat, the latter case providing an advantage where the seat may flex in response to the weight of its load.

With the chair of FIG. 8, the non-upholstered seating surface 242 is formed of a flexible material, and flexes, bends, or deflects downwardly and into the seat frame in response to, and proportional to, a user's weight. The upholstered chair 250 of FIG. 9 similarly has a seat portion 238 including a seat frame 244 with a flexible seating surface 242 attached thereto. However, this chair also includes an upholstered seat cushion 232 attached to the seating surface 242. In both the upholstered and non-upholstered configurations, seating surface is flexible in part because of the perimeter location of the seat frame 244, which allows the seating surface to cup or curve, and thus conform to the user for a custom fit. The flexible seat and back support combine to provide a chair which is both comfortable and foldable.

However, the prior folding chairs 200, 250 require significant manual labor to apply upholstery, if desired. To attach the upholstery to the back of the chair 250 of FIG. 9, the upholstery 230 is likely to be separately attached to a backing material or substrate (not shown), with the backing material or substrate then fixedly attached to the back support 224 with fasteners 234, such as screws, rivets, etc. Similarly, to attach the seat upholstery 232 to the seating surface 242, fasteners 236 are generally required.

Obviously, a large amount of labor is required to assemble these, including significant labor to apply the fasteners, and to hide unsightly edges of the upholstery fabric, etc. Additionally, because they are exposed, the fasteners which secure the upholstery backing to the chair can be subject to tampering and vandalism, in addition to the exposed fasteners 228 which affix the back support 218, 224 to the chair frame 202. These factors tend to reduce the useful life of chairs, and presents unwanted costs and aggravation for the owner. It would thus be desirable to have a tamper-proof removable cushion for a folding chair, which has hidden connectors and a hidden interlocking mechanism, yet is removable from the frame of the chair by one with proper tools and knowledge, such as for maintenance or reupholstering.

It will also be appreciated that a typical folding chair will be stored and used, folded and unfolded, stacked and unstacked, innumerable times during its useful life. With this use, the upholstered edges are highly exposed to wear and tear. It would thus be advantageous to have an upholstered chair wherein upholstery edges are hidden and protected.

Figure 2:
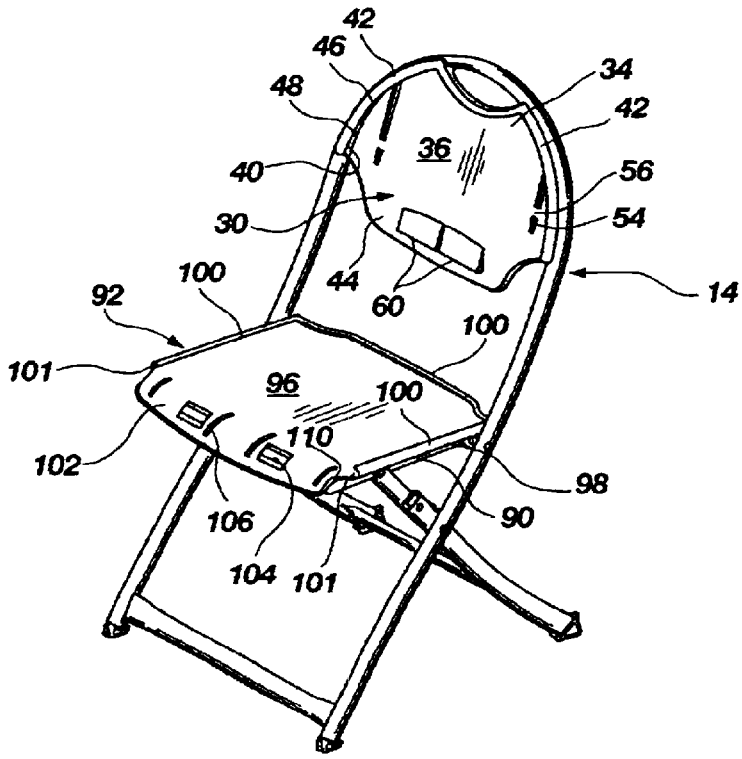
FIG. 2 is a front perspective view of the chair of FIG. 1 with the upholstered inserts removed.
Figure 3:
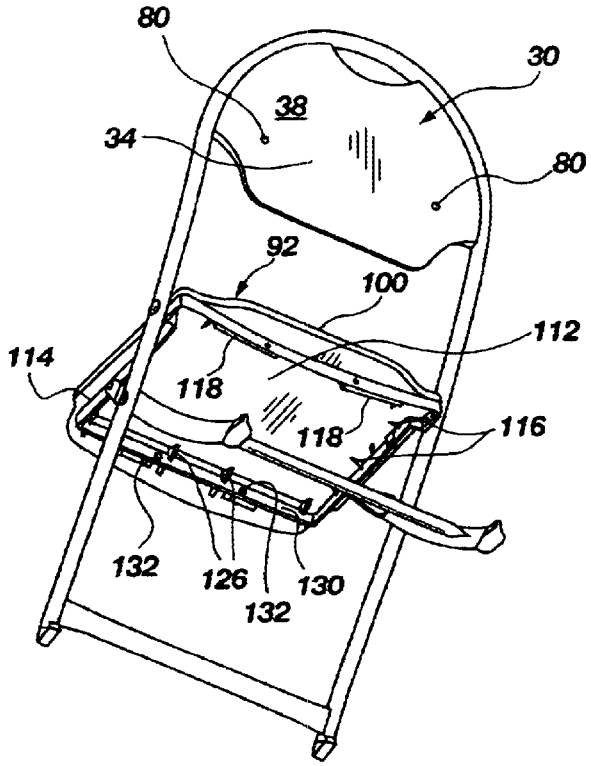
FIG. 3 is a rear perspective view of the chair of FIG. 1.

Referring to FIGS. 1–3, the present invention advantageously provides an upholstered chair 10, comprising base members which are secured to the chair frame, and removable upholstered inserts which can be inserted into and removed from the base members. Like the prior art chairs, the upholstered chair 10 includes a rigid tubular support frame 12, having an upper back support portion 14 forming the back of the chair, and a lower front leg portion 16 formed integrally and continuously with the upper back support portion. The chair also includes a rear leg portion 18, which includes left and right rear legs 20, 22, which are pivotally coupled to the support frame 12 at leg pivot points 24.

As with the prior art chairs, the support frame 12 may be shaped to form a curved spline profile for easy stacking of folded chairs. It may also have a broad curved back member 26 formed at its top, with a corresponding indentation 27 formed in the top of the back base 30, thus providing a handle space 29 for allowing a user to manually grasp the chair. The handle is thus formed by the support frame itself at the top of the chair. It will be apparent that the chair may be produced without this indentation, and that the chair frame, back base, and handle may take other forms. For example, additional support structures may extend from the sides of the frame to form a handle.

With reference to FIGS. 1–3 and 10, the chair 10 includes a back support 28 coupled to the upper back support portion 14. The back support 28 comprises a back base 30, which provides a base into which an upholstered insert 32 may be inserted and fastened. The back base may also be termed a base member or mounting member. The back base 30 generally comprises a back plate 34, with a front face 36 and a back face 38, an upper perimeter flange 40 for connecting to the upper frame portion 14 of the chair frame 12, and a retaining rim 42 extending inwardly and also slightly outwardly from the top and side portions of the perimeter flange 40. The back base is preferably made of injection molded plastic, but other materials may also be used, including metal. It preferably has a generally concave curved surface to conform to a user's back, and is flexible and bends or flexes inwardly or rearwardly as force is applied, as with the prior art chairs. Also as with the prior art chairs, the back base 30 includes a lower lumbar support region 44, which extends downwardly from the back base to flexibly support the lumbar region of a user's back.

The perimeter flange 40 includes several attachment openings, including mounting slots 46 and mounting holes 48, for allowing the back base to be fixedly attached (such as by blind rivets) to the upper frame portion 14 of the chair frame 12. These are most clearly visible in the view of FIG. 10. The inventors have found that having at least two round mounting holes 48 (one on each side of the back base 30) is desirable for ensuring accurate alignment of the back base with the chair frame. However, because of the curved shape of the upper perimeter flange 40, making all attachment openings round is difficult and complicated in an injection molding process for a back base having this curved shape. Additionally, having mounting slots 46, rather than holes only, reduces the needed level of accuracy of placement of corresponding attachment openings in the chair frame and back base, making assembly and fabrication easier and cheaper.

The retaining rim 42 extends inwardly a small distance from both sides of the perimeter flange 40, and also extends outwardly a small distance over the upper portion 14 of the support frame 12. The retaining perimeter flange 40 and rim 42 provide a channel or track (52 in FIG. 6) into which the upholstered back insert 32 may be slid, as described below. The rim 42 serves to cover and protect the edges of the upholstered insert when it is in place, while also helping to securely retain the insert within the back base, and to cover the joint between the perimeter flange 40 and the upper portion 14 of the chair frame.

Figure 10:
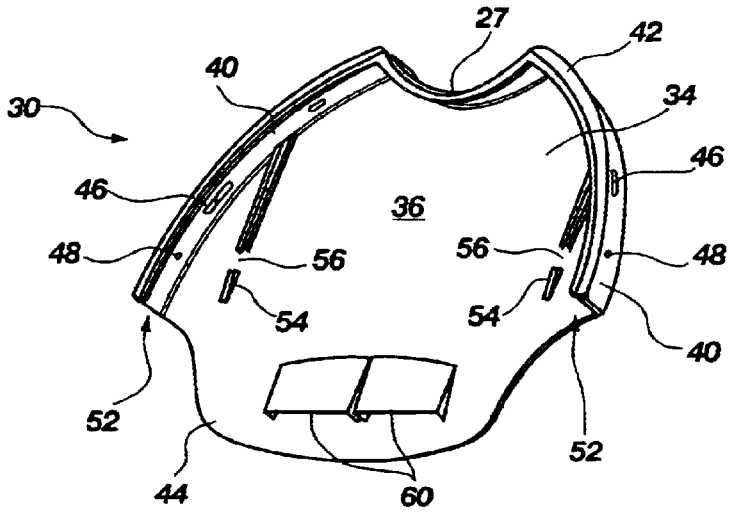
FIG. 10 is an enlarged perspective view of the back base.

Disposed on each side of the front face 36 of the back plate 34 are locking ramps 54 and locking slots 56, shown most clearly in FIG. 10. These are designed to provide an interlocking point for the locking wedges (58 in FIG. 4B) of the upholstered back insert 32, as described below. In the lower center portion of the back plate 34, adjacent to the lumbar support region 44, are receiving slots 60 configured for receiving the locking tabs 62 of the upholstered insert, also described below.

Figure 4A:
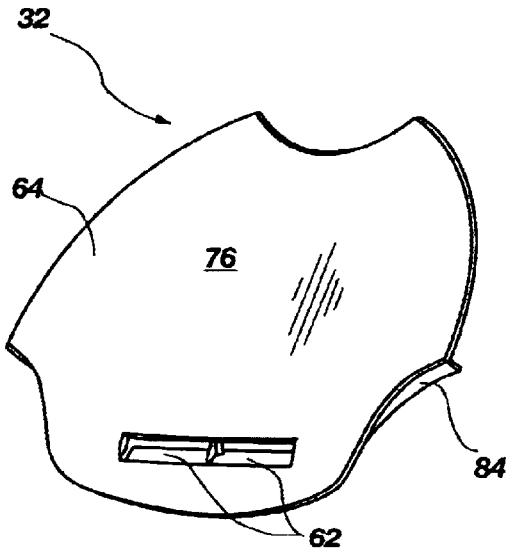
FIG. 4A is a front perspective view of the back insert.
Figure 4B:
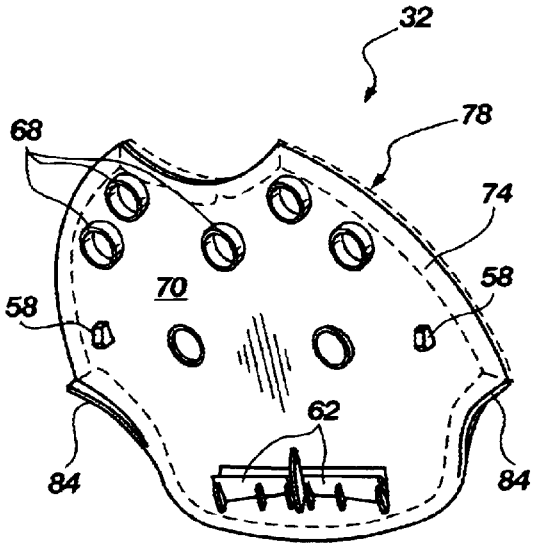
FIG. 4B is a rear perspective view of the back insert, showing the method of attachment of the upholstery fabric to the insert.

Referring to FIGS. 4A and 4B, the upholstered back insert 32 comprises an insert panel 64 having locking tabs 62 at its lower end, a pair of locking wedges 58 on either side, and spacers 68 disposed at various locations along the back face 70 of the panel. The spacers 68 are shown as hollow circular protrusions, but may take many other shapes and forms. Among other functions, the spacers provide positive contact between the back panel 34 of the back base 30, and the insert panel 64, which has a greater degree of curvature. Like the back base, the back insert panel is preferably formed of a resilient plastic material, such as polyethylene or polypropylene, though other materials may be used. The locking tabs 62 and locking wedges 58, together with the receiving slots 60 and locking slots 56 of the back base, collectively comprise interlocking members, which are configured to securely fasten the upholstered insert 32 to the back base 30.

Figure 6:
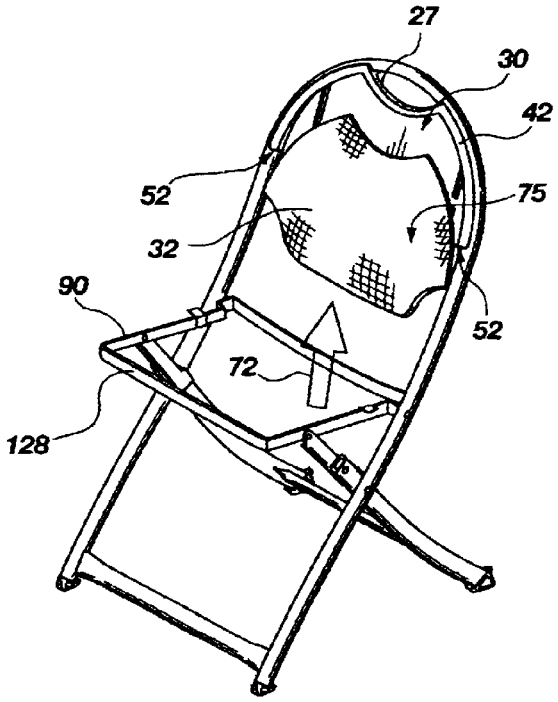
FIG. 6 is a perspective view showing the procedure for inserting the back insert into the back base.

Shown in FIG. 6 is a pictorial view of the completed back insert 32 being inserted into the back base 30. Generally, the insert is inserted into the back base by sliding it upwardly into the track or channel 52 formed by the retaining perimeter frame 40 and retaining rim 42. As the insert is inserted upward into the back base, as indicated by arrow 72, the spacers 68 push the panel outward against the underside of the retaining rim 42, and the locking wedges 58 ride up on the locking ramps 54 until they reach the location of the locking slots 56. Upon reaching that point, the locking wedges resiliently snap into the locking slots, thus preventing the insert from sliding or being pulled downward and out of the back base. At the same time, the locking tabs 62 slide into the receiving slots 60, the opposing angled faces of these two structures contacting each other and acting to draw the insert toward the back base, preventing the upholstered insert from being pulled forward, away from the back base, particularly in the lower lumbar support region 44. The retaining rims 42 also assist in this function. When the insert is properly and fully inserted into the back base, the interlocking members are thus disposed between the back base and the insert panel, being hidden from view and giving a neat appearance.

The upholstery 74 for the seat back is disposed over the front face 76 of the insert panel 32, with the fabric wrapped around the edges of the panel and secured along the perimeter of the back face 70 with staples, adhesive, or any other suitable method, as shown in FIG. 4B. This configuration produces upholstery edges 78, which could be susceptible to damage if not properly protected. However, the retaining rims 42 advantageously cover and protect the upper and side portions of the upholstery edges, as shown in FIG. 1. Specifically, FIGS. 1 and 6 show that the retaining rim wraps around the edge of the upholstered insert to cover both the edge of the upholstery and a portion of the front face 75 of the upholstery. This helps the chair last longer and look better.

When desired, the upholstered back insert 32 can be removed from the chair 10, such as for reupholstering, cleaning, repair, etc. Viewing FIG. 3, disposed on the back face 38 of the back panel 34 of the back base 30 are a pair of access markings 80, which indicate the location of insert removal access points. These access points are aligned with the locking slots 56 of the back base, and comprise covered holes into which an elongate object, such as an awl, may be inserted to push the locking wedges 58 forwardly, out of the slots, thus allowing the insert to be pulled downwardly out of the back base.

The access markings 80 preferably comprise small dimples or circular indentations, which are integrally formed with the back panel 34 at the location of the access points. The covering of the access points may be a thinned or weakened region of material on the back panel, which allows a user to push the elongate object through, or which may be easily drilled out to allow insertion of the elongate object. The nature of the access markings gives the back face a neat appearance, without providing any indication to an untrained or unknowing observer that a means of removing the upholstered insert exists. This helps prevent tampering or vandalism of the chairs.

Referring back to FIGS. 4A and 4B, the back insert panel 32 also includes small gap filler panels 84 at the sides of the lower extremity of the panel. These are primarily for appearance, and fill the gap between the lower edge of the panel and the back plate 34 at the lower end of the back base, providing a transition from the relatively thin cross-section of the lower lumbar support region 44, to the thicker cross-section at the edges.

The chair 10 also includes a seat portion 86 pivotally coupled to the support frame 12 at seat pivot points 88. The seat portion and related structures are shown clearly with reference to FIGS. 1–3 and FIG. 6. The seat portion 86 includes a seat frame 90, to which is attached a seat base 92, which is configured to receive a seat insert 94. As with the prior art chairs, the seat frame extends generally around the perimeter of the seat, or along the sides, front and back of the seat.

The seat base and seat insert are shown in FIGS. 2, 5A–B and FIG. 7. The seat base generally comprises a slightly cupped base panel 96, with a perimeter flange 98 and retaining rim 100 on the top, the retaining rim extending inwardly from the sides and back of the panel. The perimeter flange and retaining rim together create a channel or track 101 into which a seat insert may be inserted, as described below. The front edge 102 of the base panel 96 curves downwardly for comfort, and includes fastener slots 104 and wedge slots 106 for allowing passage of corresponding elements of the upholstered seat insert 94, described below. The front edge 102 of the seat base 92 also includes a forward lip 110 on each side, for protecting the sides of the forward edge of the upholstered insert. The forward lips 110 perform a function similar to the gap filler panels 84 of the seat back insert 32.

Referring particularly to FIG. 3, the underside 112 of the seat base 92 includes a perimeter bearing rib 114 and locating gussets 116. The bearing rib is designed to bear directly on the chair seat perimeter frame 90, while the gussets help keep the frame in proper alignment with the rib. The bearing rib is designed to provide a substantially flat bearing surface for the chair seat frame, while allowing for the curved profile of the chair seat. At the rear of the bottom of the seat base are two rear fastening tabs 118 for permanently affixing the seat base to the seat frame, such as with rivets.

Figure 5A:
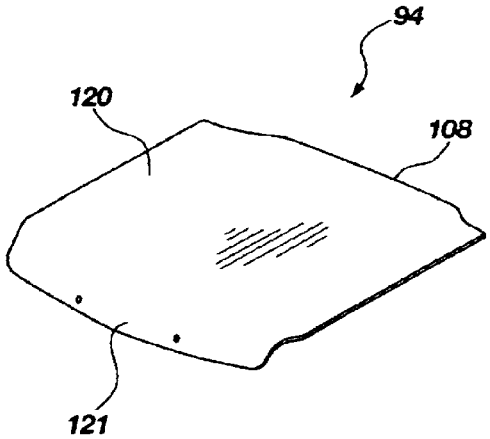
FIG. 5A is a top perspective view of the seat insert.
Figure 5B:
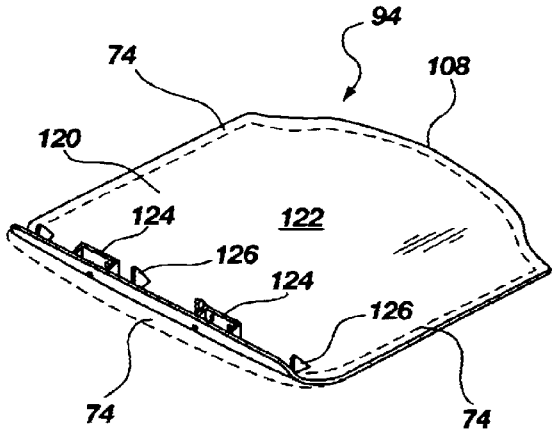
FIG. 5B is a bottom perspective view of the seat insert, showing the method of attachment of the upholstery fabric thereto.

Referring to FIGS. 3, 5A, 5B, and 6, the upholstered seat insert 94 generally comprises an insert panel 120 having a downwardly curved front edge 121, and a general shape which is comparable to the seat base 92, and which is designed to mate therewith. The bottom 122 of the seat insert panel includes front fastening tabs 124, and locking wedges 126. The fastening tabs and locking wedges together comprise interlocking members for attaching the seat insert to the seat frame 90. The front fastening tabs are configured to be removably fastened, such as with screws, to the front face 128 of the front of the seat frame. The locking wedges are designed to pass over the front of the seat frame, and snap into place against the back face 130 of the front of the seat frame. As in the case of the back insert 32, the upholstery fabric 74 of the seat insert 94 simply wraps around the edge of the insert panel 120, as shown in FIG. 5B, where it is fastened with staples, adhesive, or any other suitable method. Also, as with the back insert, the retaining rim wraps around the edge of the seat insert so as to cover both the edge of the upholstery and a portion of the front face 75 of the upholstery.

Figure 7:
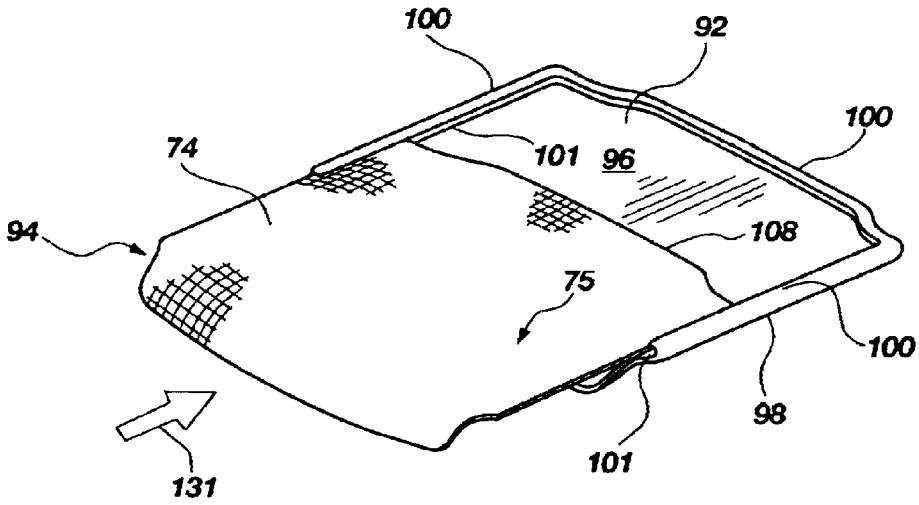
FIG. 7 is a perspective view showing the procedure for inserting the seat insert into the seat base.

Shown in FIG. 7 is the procedure for inserting the seat insert 94 into the seat base 92. The user first aligns the sides of the back edge 108 of the insert with the channels or tracks 101 below the front of the retaining rims 100, while holding the front edge 121 of the insert. The user then pushes the insert toward the back, in the direction of arrow 131, sliding it in the track under the retaining rims, until the front fastening tabs 124 and locking wedges 126 pass through the corresponding slots 104, 106 on the front edge 102 of the seat base.

The entire procedure for attaching the seat base and seat insert to the chair frame may be done in more than one way. As one option, the seat insert may first be inserted into the seat base in the manner described above, then the assembled seat base and insert may be attached to the seat frame 90 as a unit. In this process, the front fastening tabs 124 of the seat insert and the rear fastening tabs 118 of the seat base are both placed in their respective positions at basically the same time, and fastened to the seat frame. Alternatively, the seat base may first be put in place and attached to the chair frame via the rear fastening tabs. Then the seat insert is inserted into track 101 of the seat base, the such that the locking wedges pass over the front of the chair seat frame 90 and drop into position against the back 130 of the seat frame, while the front fastening tabs are disposed against the front 128 of the seat frame.

Once inserted, the back edge 108 of the seat insert 94 will have nested below the back portion of the retaining rim 100, and the seat insert will substantially conform to the shape of the seat base 92, including the downwardly curved front edge 102. Referring to FIGS. 3 and 5B, the front fastening tabs 124 may then be secured to the front 128 of the seat frame 90, securing the front of the insert directly to the seat frame. Removal of the seat insert from the seat base simply requires removal of the screws or other fasteners (132 in FIG. 3) which connect the front fastening tabs 124 to the chair frame 90, then sliding the seat insert forwardly out of the seat base.

Notwithstanding the addition of the upholstered inserts and support structure therefore, the upholstered chair of the present invention still provides a flexible and lightweight seat and back support, which combine to provide a chair which is both comfortable and foldable. Advantageously, the upholstered inserts are removable, the interlocking mechanism is hidden, and the upholstered edges are protected from wear.

It is to be understood that the above-described arrangements are only illustrative of the application for the principles of the present invention. Numerous modifications and alternative arrangements can be devised without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment (s) of the invention, it will be apparent to those of ordinary skill in the art that numerous modifications can be made without departing from the principles and concepts of the invention as set forth in the claims.

What is claimed is:

1. An upholstered chair, comprising:

a. a foldable chair frame having back and seat portions;

b. an upholstered insert, comprising an insert panel, having upholstery edges and an upholstered front face; and c. at least one of the back and seat portions comprising a base having a track mounting structure configured to slidably receive the upholstered insert, the track mounting structure further comprising oppositely disposed retaining rims configured to wrap around the edge of the upholstered insert to cover both the edge of the upholstery and a portion of a front face of the upholstery.

2. A chair in accordance with claim 1, further comprising a locking wedge associated with the insert panel, configured to interlock with at least one of the chair frame and the base.

3. A chair in accordance with claim 2, wherein the base comprises a seat base, the upholstered insert comprises a seat cushion, and the locking wedge is configured to interlock with a seat frame member, the seat base being permanently attached to the seat frame member.

4. A chair in accordance with claim 2, wherein the base comprises a back base, the upholstered insert comprises a back cushion, and the locking wedge is configured to interlock with the back base.

5. A chair in accordance with claim 4, further comprising:

a locking tab, and spacer members associated with the insert panel; and b. a receiving slot and a locking slot, associated with the back base, the spacer members configured to bias the insert away from the back base, the receiving slot configured to interlock with the locking tab, and the locking slot configured to receive and interlock with the locking wedge to fasten the insert to the back base.

6. A chair in accordance with claim 5, wherein the locking tab, the locking wedge, the spacer members, and the locking slot are disposed on facing sides of the upholstered insert and the back base, and thereby hidden from view when the upholstered insert is fastened in the back base.

7. A chair in accordance with claim 6, further comprising insert removal access points, disposed on the back base, configured to allow a user to insert an elongate object through the back base to release the locking wedge from the locking slot, so as to allow removal of the upholstered insert from the back base.

8. A chair in accordance with claim 7, wherein the insert removal access points are covered by tabs, integrally formed with the back base, such that the existence and location of the access openings is not readily apparent to an uninformed observer.

9. A chair in accordance with claim 8, further comprising insert removal access markings, indicating the location of the insert removal access points.

10. A chair in accordance with claim 8, wherein the tabs which cover the insert removal access points may be removed by a method selected from the group consisting of: pressing an elongate object against the tab to puncture it; and drilling through the tab.

11. An upholstered chair, comprising:

a. a chair frame;

b. a base member, secured to the chair frame, and having an insert track; and c. a removable upholstered insert, having upholstered edges and an upholstered front face, configured to be inserted into and removed from the insert track of the base member, the insert track being further configured to (i) wrap around and cover and protect at least a portion of the upholstered edge and the front face of the upholstery, and (ii) secure the removable insert to the base member.

12. An upholstered chair in accordance with claim 11, further comprising:

a. interlocking members, configured to interlock and draw together the base member and the removable insert; and b. biasing members, configured to bias the base member and the removable insert away from each other, such that the removable insert is securely attachable to the base member.

13. An upholstered chair in accordance with claim 12, further comprising means for releasing the interlocking members, so as to allow removal of the removable insert from the base member.

14. An upholstered chair in accordance with claim 13, wherein the means for releasing the interlocking members is substantially hidden from view, such that the existence and location of the means for releasing the interlocking members is not readily apparent to an observer.

15. An upholstered folding chair, comprising:

a. a folding chair frame, having an upper frame portion and a seat frame portion;

b. a back base, permanently attached to the upper frame portion of the chair frame, having a locking slot, and oppositely disposed retaining rims on upper and side portions thereof;

c. a seat base, permanently attached to the seat frame portion of the chair frame, having oppositely disposed retaining rims on side and rear portions thereof;

d. an upholstered back insert, having upholstery edges, spacer members, and a locking wedge, the back insert configured to slide into the back base between the oppositely disposed retaining rims, the rims covering and protecting at least some of the upholstery edges, the spacer members and locking wedge configured to (i)

bias the insert against the rims, and (ii) fasten the insert to the back base; and e. an upholstered seat insert, having upholstery edges, a plurality of locking wedges, and a fastening tab, the seat insert configured to slide into the seat base between the oppositely disposed retaining rims, the rims covering and protecting at least some of the upholstery edges, the locking wedges being configured to bias the insert against the lower pivoting frame portion of the chair to thereby hold it within the seat base, and the fastening tab being configured to allow the insert to be fastened to the lower pivoting frame portion.

16. A method for adapting a folding chair with a cushioned seat and back, comprising the steps of:

a. securing a base member to a chair frame;

b. inserting an upholstered insert having upholstery edges and an upholstered front face into retaining rims of the base member, such that the retaining rims wrap around and cover and protect at least a portion of the upholstery edges and the upholstered front face; and c. connecting interlocking members between the upholstered insert and at least one of the base member and the chair frame, so as to fasten the upholstered insert to the chair.

17. A method in accordance with claim 16, wherein the step of securing the base member to the chair frame further comprises the steps of:

a. securing a back base to an upper portion of the chair frame; and b. securing a seat base to a lower portion of the chair frame.

18. A method in accordance with claim 16, further comprising the step of removing the upholstered insert from the base member by inserting an elongate object through an insert removal access point in the base member, so as to disconnect the interlocking members.

* * * * *